United States Patent [19]

Patterson

[11] Patent Number: 5,036,031

[45] Date of Patent: Jul. 30, 1991

[54] METAL PLATED MICROSPHERE CATALYST

[76] Inventor: James A. Patterson, 2074 20th St., Sarasota, Fla. 34234

[21] Appl. No.: 413,980

[22] Filed: Sep. 28, 1989

Related U.S. Application Data

[62] Division of Ser. No. 353,260, May 16, 1989, Pat. No. 4,943,355.

[51] Int. Cl.[5] ..... B01J 35/08

[52] U.S. Cl. ..... 502/10; 502/20; 502/159

[58] Field of Search ..... 502/159, 10, 20

[56] References Cited

U.S. PATENT DOCUMENTS

| | | | |
|---|---|---|---|
| 2,915,406 | 12/1959 | Rhoda et al. | 428/655 X |
| 3,577,324 | 5/1971 | Patterson | 204/20 |
| 3,965,039 | 6/1976 | Chaplits et al. | 502/159 |
| 3,991,225 | 11/1976 | Blouin | 427/3 |
| 4,130,506 | 12/1978 | Collier et al. | 502/159 |
| 4,179,402 | 12/1979 | Kim et al. | 502/159 |
| 4,243,728 | 1/1981 | Sato et al. | 428/570 |
| 4,306,085 | 12/1981 | Kim et al. | 502/159 |
| 4,853,135 | 8/1989 | Oeckl et al. | 502/159 |

*Primary Examiner*—Patrick P. Garvin
*Assistant Examiner*—E. D. Irzinski
*Attorney, Agent, or Firm*—Charles J. Prescott; Raymond H. Quist

[57] ABSTRACT

Cross-linked polymer microspheres are carefully separated into fractions of equal size and density by first using sieves and then using hydraulic separation in a cone. Each fraction is separately plated with copper. The copper plated microspheres are again separated into fractions of equal size and density. Each fraction is then given an additional metal plating. The thus plated microspheres have uniformly thick plating and have a maximized surface area for the amount of metal plated making them particularly useful as catalysts or in electrical products or processes. Microspheres having a plating of palladium exhibit a marked improvement in the adsorption of hydrogen both quantitatively and in rapidity.

9 Claims, 1 Drawing Sheet

METAL PLATED MICROSPHERE CATALYST

This is a divisional of co-pending application Ser. No. 07/353,260 filed on May 16, 1989, now U.S. Pat. No. 4,943,355.

BACKGROUND OF THE INVENTION

1. Field of the Invention

This invention relates generally to metal plating and more particularly to improved an process for the uniform plating of microspheres for use in catalytic processes and electrical applications.

2. Description of Related Art

In U.S. Pat. No. 3,577,324, I described a process and apparatus for plating particles which had as a preferred embodiment the plating of polymeric beads formed from polystyrene cross-linked with divinyl benzene. A solution for bonding copper atoms to such beads was disclosed.

In U.S. Pat. No. 3,787,718, I disclosed the use of plated spherical particles as electronic components. In this patent the forming of additional coatings or platings on the copper layer was also disclosed.

U S. Pat. No. 2,915,406, Rhoda et al., entitled "Palladium Plating by Chemical Reduction", discloses a number of baths for use in immersion plating of various metals.

The present invention discloses the preparation of resin microspheres having copper salts on the outer portion. These microspheres are separated into batches of substantially uniform sizes and are then plated. By plating microspheres of the same size and density (as determined by Stoke's law) a plating of uniform thickness can be achieved. This uniformly thick plating is essential when the plated microspheres are used in catalytic beds and/or with electric current flowing. Nonuniformly thick platings will result in hot spots which will cause the plating to spall off.

SUMMARY OF THE INVENTION

In a column exchange, a resin in hydrogen form is reacted with chlorosulfonic acid, the resulting microspheres have a sulfonate surface and hydrochloric acid is contained in the solution. The microspheres are washed with deionized water. The sulfonated microspheres are next placed in an aqueous copper chloride solution. The microspheres have copper salts on the surface and hydrochloric acid is contained in the solution. The microspheres are again washed with deionized water. The resulting resin when dried is in the form of microspheres having copper salts on the exterior. These microspheres are separated by passing them through meshes of progressively decreasing size beginning with U.S. sieve cut 16–18 and ending with U.S. sieve cut 25–30. Each such separated group of microspheres is further hydraulically separated to obtain microspheres of sizes identical to $\pm 0.005$ g/cm$^3$. These microspheres are then plated with the electroless copper plating solution described in U.S. Pat. No. 3,577,324 with the required good agitation. After drying and further sorting, these microspheres are given an additional metal plating using the apparatus disclosed in the previously mentioned patent and solutions which will be described herein for various metal platings. Such plated microspheres are useful in electrical applications and in catalytic processes. For example, microspheres having a palladium outer plate have been found to occlude hydrogen in increased quantities and at faster rates than pure palladium wire or palladium plated wire.

It is therefore an object of this invention to provide a process for producing microspheres which have a plating of uniform thickness.

It is also an object of this invention to provide solutions and processes for achieving the metal plating.

In accordance with these and other objects, which will become apparent hereafter, the instant invention will now be described with reference to the accompanying drawings.

DETAILED DESCRIPTION OF THE INVENTION

Figure 1:
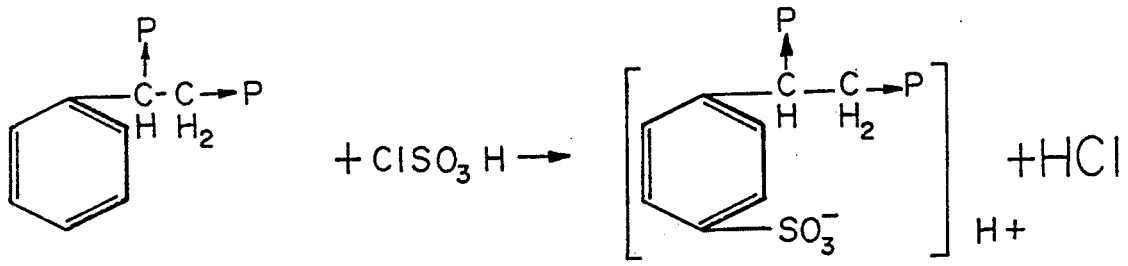
FIG. 1 depicts the reaction to produce sulfonated cross-linked polymer microspheres.
Figure 2:
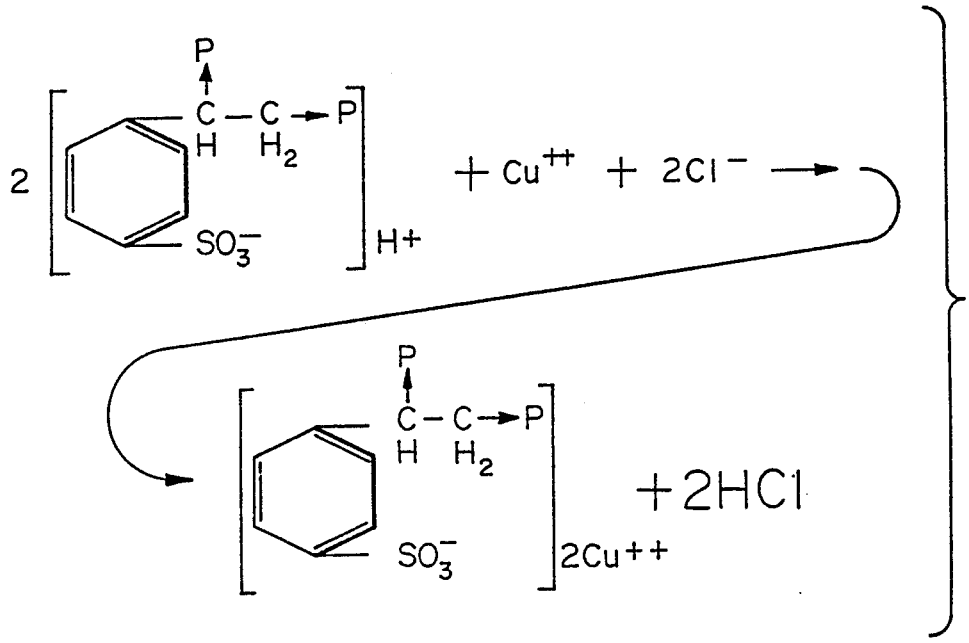
FIG. 2 depicts the reaction to produce cross-linked polymer microspheres having surface copper salts.

Polystyrene resin is reacted in a column exchange with chlorosulfonic acid yielding sulfonated polystyrene microspheres having hydrogen ions on the outer layer and hydrochloric acid, as shown in FIG. 1. This sulfonation should be limited to a 100 molecular layer depth. If sulfonation is excessive it will be found that the diameter of the microspheres will change when dry microspheres are hydrated. Following this reaction, the sulfonated polystyrene microspheres are washed with deionized water. Next aqueous copper chloride is added to the solution and substitutes for the hydrogen ions in the outer layer, as shown in FIG. 2. The microspheres are again washed with deionized water and dried. The resulting microspheres have copper salts on the exterior. The microspheres are passed through sieves to separate them into batches with each batch containing microspheres of substantially the same size. The largest cut is U.S. Sieve 16–18, followed by 18–20, 20–25 and 25–30 mesh. Each cut is then individually hydraulically separated in a cone having an upwardly laminar water flow. As is well known, in accordance with Stoke's law, microspheres of different densities and size will be found in different layers or zones . The microspheres in each zone are carefully removed separately and are now in fractions which are identical to $\pm 0.005$ grams/cm$^3$. These fractions are then copper coated using the process disclosed in U.S. Pat. No. 3,577,324. The resulting copper coated microspheres perform superiorly as electronic components and in catalytic functions because they do not develop hot spots as occurred with microspheres formed by the previous process. Such hot spots would cause the metal coating to pop off the microspheres.

For many applications a second metal coating is desired. To assure uniformity of coating, the copper coated microspheres are again hydraulically separated to an accuracy of $\pm 0.0075$ grams/cm$^3$.

Second metal platings of various metals have been performed using the apparatus disclosed in U.S. Pat. No. 3,577,324 and the solutions which will now be described.

ELECTROPLATING

| GOLD PLATING | | |
|---|---|---|
| Solution: | potassium gold cyanide $KAu(CN)_2$ | 8–16 g/l |
| | fluid potassium cyanide KCN | 23–39 ml/l |
| | potassium carbonate $K_2CO_3$ | 31–94 ml/l |
| | hydropotassium cyanide $HKCO_3$ | 23–39 ml/l |

This solution is used at a temperature of 130–160 degrees F. with a voltage of 2–5 volts DC and a current density 1–5 amp/ft$^2$ with a good upflow and agitation. The resulting plated microspheres have a smooth surface. If a heavy porous surface is desired, the polarity shown in the previously referred to patent is reversed and carbon electrodes in nylon bag covers are used with a current density of 10 amp/ft$^2$.

| SILVER PLATING | | |
|---|---|---|
| Solution: | silver cyanide AgCN | 4–5.5 ml/l |
| | potassium cyanide KCN | 78–94 ml/l |

This solution is used at a temperature of 70–85 degrees F. with a voltage of 4–6 volts DC and a current density of 15–25 amp/ft$^2$. The resulting plated microspheres have a smooth surface.

A heavy silver plate requires different parameters and solution.

| | | |
|---|---|---|
| Solution: | silver cyanide AgCN | 37.5 ml/l |
| | potassium cyanide KCN | 62.5 ml/l |
| | potassium carbonate $K_2CO_3$ | 15.6 ml/l |
| | silver metal Ag | 27.3 g/l |

This solution is used at a temperature of 70–80 degrees with a voltage of 4–6 volts DC and a current density of 5–15 amp/ft$^2$.

| PLATINUM PLATING | | |
|---|---|---|
| Solution: | chloroplatinic acid $H_2PtCl_6$ | 1–2 g/l |
| | dibasic ammonia phosphate $(NH_4)_2PO_4$ | 20 g/l |
| | dibasic sodium phosphate $Na_2HPO_4$ | 100 g/l |

This solution is used at a temperature of 65–95 degrees F. with a current density of 2–20 amp/ft$^2$. A rate of deposition of 4.8 mg/amp/min is achieved or 0.0001 inches/30–60 min/ft$^2$. The platinum may be plated over nickel.

| PALLADIUM PLATING | | |
|---|---|---|
| Solution: | palladium chloride PdCl | 50 g/l |
| | ammonium chloride $NH_4Cl$ | 50 g/l |

This solution is used at a temperature of 40–50 degrees C. with a current density of up to 10 amps/ft$^2$. Note that the voltage should be kept below 1.8 volts DC which is below $H_2$ production so that the metal surface will not pre-adsorb or occlude hydrogen. A rate of deposition of 33 mg/amp min or 0.000 inches/15 min/ft$^2$. The plated surface is a very active polymerization surface so that monomers should be kept away. One volume of palladium will adsorb up to 900 volumes of hydrogen. The palladium can be deposited over nickel.

| NICKEL PLATING | | |
|---|---|---|
| Solution: | nickel sulfate $NiSO_4$ | 156 ml/l |
| | ammonium chloride $NH_4Cl$ | 31 ml/l |
| | boric acid $H_3BO_3$ | 31 ml/l |

This is used at a temperature of 20–30 degrees C. with a voltage of 6–8 volts DC, and a current density of 5–10 amp/ft$^2$.

IMMERSION PLATING

| PALLADIUM PLATING | | |
|---|---|---|
| Solution: | palladium chloride PdCl | 4.9 g/l |
| | hydrochloric acid HCL | 250 ml/l |

This solution is used at room temperature. This coating is porous and can be sealed by a solution of 1 part ammonia to two parts water.

| NICKEL PLATING | | |
|---|---|---|
| Solution: | nickel sulfate $NiSO_4$ | 62.5 ml/l |
| | nickel ammonium sulfate $Ni(NH_4)SO_4$ | 62.5 ml/l |
| | sodium thiosulfate $Na_2S_2O_3$ | 62.5 ml/l |

This solution was used at room temperature (20–30 degrees C.).

| RHODIUM ON COPPER PLATING | | |
|---|---|---|
| Solution: | rhodium chloride RhCl | 4.9 g/l |
| | hydrochloric acid HCl | 250 ml/l |

This solution was used at room temperature in immersion plating.

| TIN ON COPPER PLATING | | |
|---|---|---|
| Solution: | tin chloride SNCl | 19.5 ml/l |
| | sodium cyanide NaCN | 195 ml/l |
| | sodium hydroxide NaOH | 23.4 ml/l |

This solution was used at room temperature in immersion plating.

| GOLD ON COPPER PLATING | | |
|---|---|---|
| Solution: | 67% potassium gold cyanide KAuCN | 3.9 ml/l |
| | sodium cyanide NaCN | 31 ml/l |
| | soda ash $NaCO_3$ | 39 ml/l |

This solution was used at 150–180 degrees F. in immersion plating.

| SILVER ON COPPER PLATING | | |
|---|---|---|
| Solution: | silver nitrate $AgNO_3$ | 7.8 ml/l |
| | ammonia hydroxide $NH_4OH$ | 78 ml/l |
| | sodium thiosulfate $Na_2S_2O_3$ | 109 ml/l |

This solution was used at room temperature in immersion plating.

| PLATINUM ON COPPER PLATING | | |
|---|---|---|
| Solution: | platinum chloride PtCl | 4.9 g/l |

-continued

| PLATINUM ON COPPER PLATING | |
|---|---|
| hydrochloric acid HCl | 250 ml/l |

This solution was used at 150 degrees F. in immersion plating.

ELECTROLESS PLATING

Electroless plating in accordance with the teachings of U.S. Pat. No. 2,874,072 has been performed as will now be described.

| COPPER PLATING | | |
|---|---|---|
| Solution: | copper nitrate $Cu(NO_3)_2$ | 15 g/l |
| | sodium carbonate $NaCO_3$ | 10 g/l |
| | rochelle salts | 30 g/l |
| | sodium hydroxide NaOH | 20 g/l |
| | 37% formaldehyde | 100 ml/l |

PH 11.5, temperature 75 degrees F., 0.1 mil/hr

A high speed, one shot bath coating of copper has been performed.

| | | |
|---|---|---|
| Solution: | copper sulfate $CuSO_4$ | 29 g/l |
| | sodium carbonate $Na_2CO_3$ | 25 g/l |
| | rochelle salts | 140 g/l |
| | versene "T" | 17 g/l |
| | sodium hydroxide NaOH | 40 g/l |
| | 37% formaldehyde | 150 g/l |

PH 11.5, Temperature 70 degrees C., 0.8 mil/hour

| NICKEL PLATING | | |
|---|---|---|
| Solution: | nickel chloride NiCl | 30 g/l |
| | ammonium chloride $NH_4Cl$ | 50 g/l |
| | sodium citrate Na Cit | 100 g/l |
| | sodium hydrophosphate $NaHPO_4$ | 10 g/l |

PH 10, Temperature 190 degrees F., adjust PH with NH OH constantly, 0.3 mil/hr.

| PALLADIUM PLATING | | Still | Moving |
|---|---|---|---|
| Solution: | tetramine palladium chloride | 5.4 | 7.5 g/l |
| | disodium EDTA | 33.6 | 8.0 g/l |
| | hydrazine | 0.3 | |
| | ammonium hydroxide $NH_4OH$ | 350 | 280 g/l |
| | temperature | 175 | 95° F. |

CATALYTIC SUPPORTED METALS

Only thin metal films are required for catalytic activity. One of the active metal groups for producing surface catalytic reactions is the nickel (58.69), palladium (106.70), white gold (197.20), platinum (195.23) with specific gravities of 8.9, 12.02, 21.45 g/cm$^3$, respectively. For example, palladium (Pd) surface will adsorb hydrogen gas. This adsorption will be used as an example to show an improvement in surface activity of metals coated on small stable plastic spheres.

PALLADIUM COATING OF PLASTIC SPHERES 100.000 grams of plastic microspheres were treated as described to produce a flash copper coating. The copper coated microspheres when dry exhibit a static surface charge. Density of microspheres as determined by S.V.S., U.S. Pat. No. 4,196,618 was 1.0550 +/−0.0005 gm/cm$^3$ dry. A 0.1000 cm$^3$ tube was used in S.V.S. in conjunction with a Metler analytical balance. The microspheres were coated with palladium using three coating techniques, electroplating, immersion plating and electroless plating. In addition, coils of 100.000 gm, 0.05 mm diameter copper wire were coated using the same technique as the microspheres. All microspheres and wire were coated to give a weight of 20.000 grams of palladium.

TABLE OF RESULTS

| PALLADIUM COATING | BEADS | | | WIRE | | |
|---|---|---|---|---|---|---|
| WEIGHT | 100.00 grams | | | 100.00 grams | | |
| WEIGHT Pd | 20.00 grams | | | 20.00 grams | | |
| | SPECIFIC GRAVITY OF Pd COATING IN GRAMS/CM$^3$ | | | | | |
| PLATING | E | I | EL | E | I | EL |
| | 11.99 | 11.40 | 11.1 | 12.00 | 11.95 | 11.85 |
| | 11.85 | 11.00 | 10.75 | | | |

E = ELECTRODEPOSITION
I = IMMERSION
EL = ELECTROLESS

HYDROGEN LOADING OF Pd SURFACES

As is well known, palladium in noted for its tendency to adsorb hydrogen. When finely divided, it takes up about 800 times its own volume. See Smith's College Chemistry by James Kendall, The Century Co., 1926, at page 630. Given below are comparative results of adsorption of hydrogen by palladium plated cross-linked polymer microspheres, palladium plated wire and pure palladium wire.

| VOLUMES OF HYDROGEN/VOLUME OF Pd | | | | | | | | |
|---|---|---|---|---|---|---|---|---|
| MICROSPHERES | | | Pd PLATED WIRE | | | PURE Pd WIRE | | |
| E | I | EL | E | I | EL | E | I | EL |
| 900 | 910 | 950 | 580 | 590 | 610 | | 570 | |
| 950 | 975 | 1050 | | | | | | |

1 volume Pd to x volumes hydrogen

Using specific gravity of Pd at 12.02 gm/cm$^3$ and coating weight for Pd volume and standard gas conditions for hydrogen, a volume of metal to volume of hydrogen is given as loading, i.e. where the Pd coating on the beads range from 1.962 to 1.760% of the microsphere volume.

Microspheres range in size from 2 mm to 10 microns.

It is seen that the plated microspheres take up a larger volume of hydrogen per unit volume of Pd than either plated wire or pure Pd wire. This shows the improved catalytic nature of metal coated microspheres over plated or pure metal wire. The volume of metal on plated microspheres shows that considerably less metal is required on the microsphere to give improved reactions over the pure metal. Using the Pd—hydrogen up take as the example.

Extension of the metal coating bead catalytic effects can be extended to cover the isotopes of the reactions shown. See U.S. Pat. No. 3,632,496, where the reactor of FIG. 2 has isolated contact electrodes with an applied electrical potential across the catalyst. Bead bed is Pd/Hydrogen.

Figure 3:
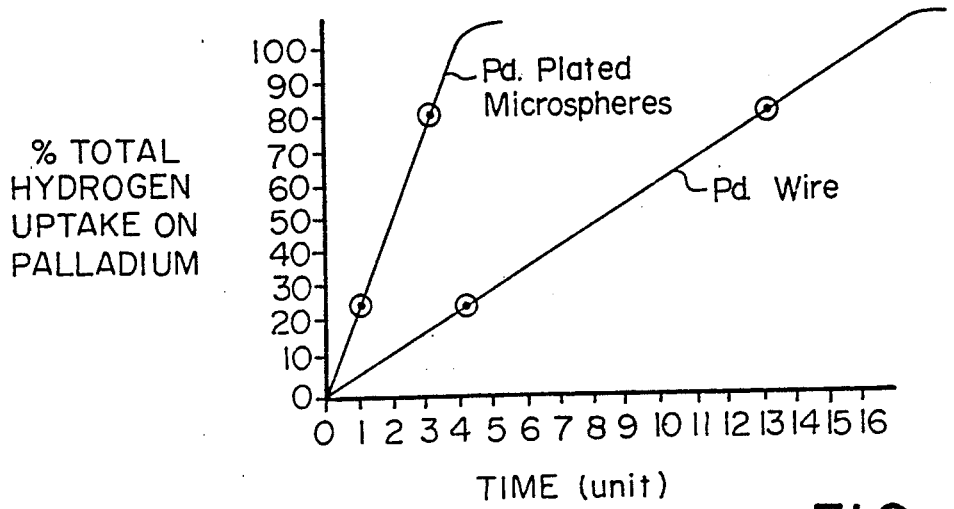
FIG. 3 is a graph showing relative times for total adsorption of hydrogen by palladium coated microspheres and palladium wire.

A remarkable result relating to the adsorption of hydrogen by palladium is depicted in FIG. 3. Palladium plated cross-linked polymer microspheres having an outside diameter of essentially 0.8 mm and palladium wire were exposed to hydrogen under standard conditions of temperature and pressure. In unit periods of time as shown in FIG. 3, the microspheres are found to reach maximum uptake in a much shorter period than the wire. It is believed that the adsorption occurs more rapidly on the surface and the beads present a much higher surface area. In addition, it appears that the thinner the metal plate on the beads, the more rapidly the adsorption occurs, since the hydrogen does not have to penetrate deeply. Moreover, this thin coating does not adversely effect the electrical conduction properties when these microspheres are used as a catalyst in electrochemical or electro induced reactions. Consequently, the shell metal not only produces a greater product yield, but also produces it faster.

Based on the foregoing, the palladium coated microspheres represent an ideal adsorber for hydrogen and its isotopes. Other uses for the plated microspheres of the various metals described above will be apparent to those who typically use such metals as catalysts. The plated microspheres provide enhanced catalytic activity because the surface area is maximized for the weight and volume of the metal.

While the instant invention has been shown and described herein in what is conceived to be the most practical and preferred embodiment, it is recognized that departures may be made therefrom within the scope of the invention, which is therefore not to be limited to the details disclosed herein, but is too be afforded the full scope of the claims so as to embrace any and all equivalent apparatus and articles.

I claim:

1. A catalyst comprising:

a plurality of microspheres of equal size and density having a palladium plating of uniform thickness ranging from 1.962 to 1.760% of the microsphere volume formed atop a copper plate of uniform thickness;

said palladium plating having adsorbed hydrogen in a volume ratio in the range of 900 to 1050, hydrogen to palladium, respectively.

2. A catalyst in accordance with claim 1 wherein:

the plates microspheres have a volume of from $2.094\times10^{-5}$ m$^3$ to $418.9\times10^{-5}$ m$^3$.

3. A palladium plated catalyst having high hydrogen adsorption comprising:

a plurality of microspheres having platings of a copper and then palladium atop said copper plating each of uniform thickness;

said microspheres being separated into batches of equal diameters;

said diameters ranging from $2\times10^{-3}$ to $10\times10^{-6}$ meters;

said platings ranging in thickness from $6.500\times10^{-6}$ meters to $0.030\times10^{-6}$ meters;

said palladium plating having adsorbed hydrogen in a volume ration in the range of 900 to 1050, hydrogen to palladium, respectively.

4. A palladium plated catalyst having high hydrogen adsorption comprising:

a plurality of microspheres having platings of uniform thickness;

said microspheres being separated into batches of equal diameters;

said palladium plating formed on copper plated plastic microspheres by electroplating with a solution of palladium chloride and ammonium chloride;

said palladium plating having adsorbed hydrogen in a volume ratio in the range of 900 to 1050, hydrogen to palladium, respectively.

5. A palladium plated catalyst having high hydrogen adsorption in accordance with claim 4 wherein:

said plastic microspheres are cross-linked polystryene.

6. A palladium plated catalyst having high hydrogen adsorption comprising:

a plurality of microspheres having platings of uniform thickness;

said microspheres being separated into batches of equal diameters;

said palladium plating formed on copper plated plastic microspheres by immersion plating in a solution of palladium chloride and hydrochloric acid;

said palladium plating having adsorbed hydrogen in a volume ratio in the range of 900 to 1050, hydrogen to palladium, respectively.

7. A palladium plated catalyst having high hydrogen adsorption in accordance with claim 6 wherein:

said plastic microspheres are cross-linked polystyrene.

8. A palladium plated catalyst having high hydrogen adsorption comprising:

a plurality of microspheres having platings of uniform thickness;

said microspheres being separated into batches of equal diameters;

said palladium plating formed on copper plated plastic microspheres by electroless plating using a solution of copper nitrate, sodium carbonate, rochelle salts, sodium hydroxide and formaldehyde;

said palladium plating having adsorbed hydrogen in a volume ration in the range of 900 to 1050, hydrogen to palladium, respectively.

9. A palladium plated catalyst having high hydrogen adsorption in accordance with claim 8 wherein:

said plastic microspheres are cross-linked polystyrene.

* * * * *

UNITED STATES PATENT AND TRADEMARK OFFICE

CERTIFICATE OF CORRECTION

PATENT NO. : 5,036,031

DATED : July 30, 1991

INVENTOR(S) : James A. Patterson

It is certified that error appears in the above-identified patent and that said Letters Patent is hereby corrected as shown below:

In column 7, Line 47, replace "plates" with --plated--.

In column 8, Line 51, replace "ration" with --ratio--.

Signed and Sealed this

Twenty-fourth Day of November, 1992

*Attest:*

DOUGLAS B. COMER

*Attesting Officer*

*Acting Commissioner of Patents and Trademarks*